United States Patent [19]

Palmer et al.

[11] Patent Number: 4,624,390

[45] Date of Patent: Nov. 25, 1986

[54] NATURAL GAS FUELING SYSTEM

[75] Inventors: Stephen W. Palmer, El Monte; Donald R. Gneiding, Fullerton, both of Calif.

[73] Assignee: Dual Fuel Systems, Inc., Montebello, Calif.

[21] Appl. No.: 594,847

[22] Filed: Mar. 29, 1984

[51] Int. Cl.[4] ..... B67D 5/06; B67D 5/32

[52] U.S. Cl. ..... 222/3; 222/74; 222/108; 222/153; 222/173; 222/394; 222/529; 222/530; 137/614.04; 285/1

[58] Field of Search ..... 222/14–23, 222/25–28, 36, 37, 71–75, 153, 173, 526, 527, 529, 530, 538, 108, 109, 3, 4, 394; 141/116, 290, 311 A; 285/1, 2, 3, 304; 248/75, 552; 239/282, 283; 137/615, 614.03, 68.1, 614.04, 614.05, 616; 251/149.6; 55/310, 169, 205; 98/115.1–115.3

[56] References Cited

U.S. PATENT DOCUMENTS

| | | | |
|---|---|---|---|
| 1,613,845 | 1/1927 | Peterson et al. | 222/109 |
| 2,210,176 | 8/1940 | Newman | 98/115.1 X |
| 2,449,938 | 9/1948 | Hansen | 137/614.03 |
| 2,906,280 | 9/1959 | Mount | 137/68 R |
| 2,964,918 | 12/1960 | Hansen et al. | 222/394 UX |
| 3,781,039 | 12/1973 | Locke et al. | 285/1 |
| 4,098,438 | 7/1978 | Taylor | 222/529 |
| 4,195,674 | 4/1980 | Madden | 222/74 X |
| 4,252,161 | 2/1981 | Krupp | 222/538 X |
| 4,483,359 | 11/1984 | Robertson | 285/3 X |

*Primary Examiner*—Joseph J. Rolla
*Assistant Examiner*—Kevin P. Shaver
*Attorney, Agent, or Firm*—Christie, Parker & Hale

[57] ABSTRACT

A natural gas fueling system is set forth for filling one or more vehicle tanks from a supply such as a storage tank or a main gas line. The system includes at least one hose assembly having one end adapted to connect to a tank and the other end having a female coupling. Also included is a dispensing assembly having a manually operated valve to control the flow of gas from supply. Connected to the valve is at least one male coupling adapted to be releasably received by the female coupling. The male and female couplings permit the hose assembly to be pulled and disconnected from the dispensing assembly to prevent damage to the hose or dispensing assembly. Additionally, the couplings are provided with check valves to stop the flow of gas when disconnected. A vent is provided to vent any leaking gas as is a locking structure to lock each hose assembly to prevent unauthorized use.

1 Claim, 6 Drawing Figures

NATURAL GAS FUELING SYSTEM

FIELD OF THE INVENTION

This invention relates to natural gas supply systems for filling tanks, and more particularly, to natural gas supply systems for refueling tanks on vehicles.

BACKGROUND OF THE INVENTION

It is well known that the majority of vehicles used today are either gasoline or diesel fuel powered. However, based upon a variety of factors such as reduced pollution emission, availability, and low cost, natural gas can be a viable alternative fuel to power vehicles. Fleets of vehicles are already powered by natural gas which, compared to gasoline and diesel fuel, results in a substantial reduction in emitted pollutants.

To supply natural gas to the vehicle's engine, which may be a turbine but which is most likely an internal combustion engine, the vehicle has at least one natural gas pressure tank. The tank is charged, or pressurized, with natural gas which, in a well known fashion, supplies the natural gas to the engine. As the natural gas is expended, the pressure in the tank decreases and eventually the tank must be refueled (pressurized) with natural gas. Accordingly, there is a need for a natural gas fueling system to fill vehicle tanks from a source of supply such as a storage tank or a gas main.

Fueling the vehicle tanks to a pressure at which the tank is determined to be full requires a period of time. For two or more vehicles or for vehicles having two or more tanks, there is a need that the natural gas supply system be able to simultaneously pressurize two or more tanks.

From the natural gas storage tank or gas main, it has been known to provide a flexible hose adapted to connect to the vehicle tank for filling. On occasion it has been known for vehicles to drive away without first uncoupling the hose from the tank. This results in the hose being pulled from the gas supply releasing the flammable natural gas both from the supply and from the vehicle tank. Accordingly, there is a need to provide a coupling means for closing the supply and hose, should the hose be pulled from a supply line.

Along these same lines, the flexing, pulling and tugging of the hose stresses the coupling means between the hose and the gas supply which may damage the coupling between the hose and the supply or prevent proper release of the hose from the supply, should the vehicle be driven away.

Accordingly, there is a need to protect and strengthen the system in the vicinity of the coupling between the hose and the supply and to assure that should the vehicle be driven away without disconnecting the hose that the coupling means will properly function to release the hose and prevent the escape of gas. When the hose or hoses are not is use, they are stored typically in an upright orientation on a stanchion or the like safely out of the way of vehicles. To vent any gas escaping from the hose, there is a need to store the hose at a vent which will vent the lighter than air natural gas safely away from the vehicle area.

To prevent unauthorized use of the natural gas filling system, there is also a need for means to lock the hose to the support stanchion or the like.

SUMMARY OF THE INVENTION

There is, therefore, provided in the practice of this invention, according to the presently preferred embodiment, a natural gas fueling system for filling a tank on a vehicle. The system includes at least one hose having one end adapted to connect to the vehicle tank. A hand valve is provided at the end to deliver gas to the tank when open and stop the flow of gas when closed. The other end of the hose is coupled to a connection in a dispensing assembly. Natural gas from a supply such as storage tank is supplied through a dispensing valve to the connection, through the hose to the tank. A pressure gauge communicates with the connection to register the pressure of the vehicle tank.

Detachable coupling means are provided to attach the hose to the connection. To prevent the escape of natural gas should the hose be pulled from the connection, the coupling means includes means for closing the connection and hoses. To protect the coupling between the hose and pressure assembly, a detachable protective shroud is provided about the coupling and a portion of the hose adjacent to the coupling. The shroud holds and stiffens the hose in the region adjacent to the coupling to reduce stresses resulting from bending or pulling of the hose. Additionally, the shroud assures the proper detaching function of the coupling means.

A stanchion is provided to store the hose or hoses when not in service. Means are provided on the stanchion to lock the hose and prevent unauthorized use. Furthermore, the stanchion is provided with a gas vent having a hood to collect and safely vent escaping gas from the stored hose or hoses.

BRIEF DESCRIPTION OF THE DRAWINGS

These and other features and advantages of the present invention will be appreciated as the same becomes better understood by reference to the following detailed description of the presently preferred embodiment when considered in connection with the accompanying drawings wherein:

FIG. 5 is a section view of the fueling system showing the locking of the hose assembly.

DETAILED DESCRIPTION OF THE DRAWINGS

Figure 1:
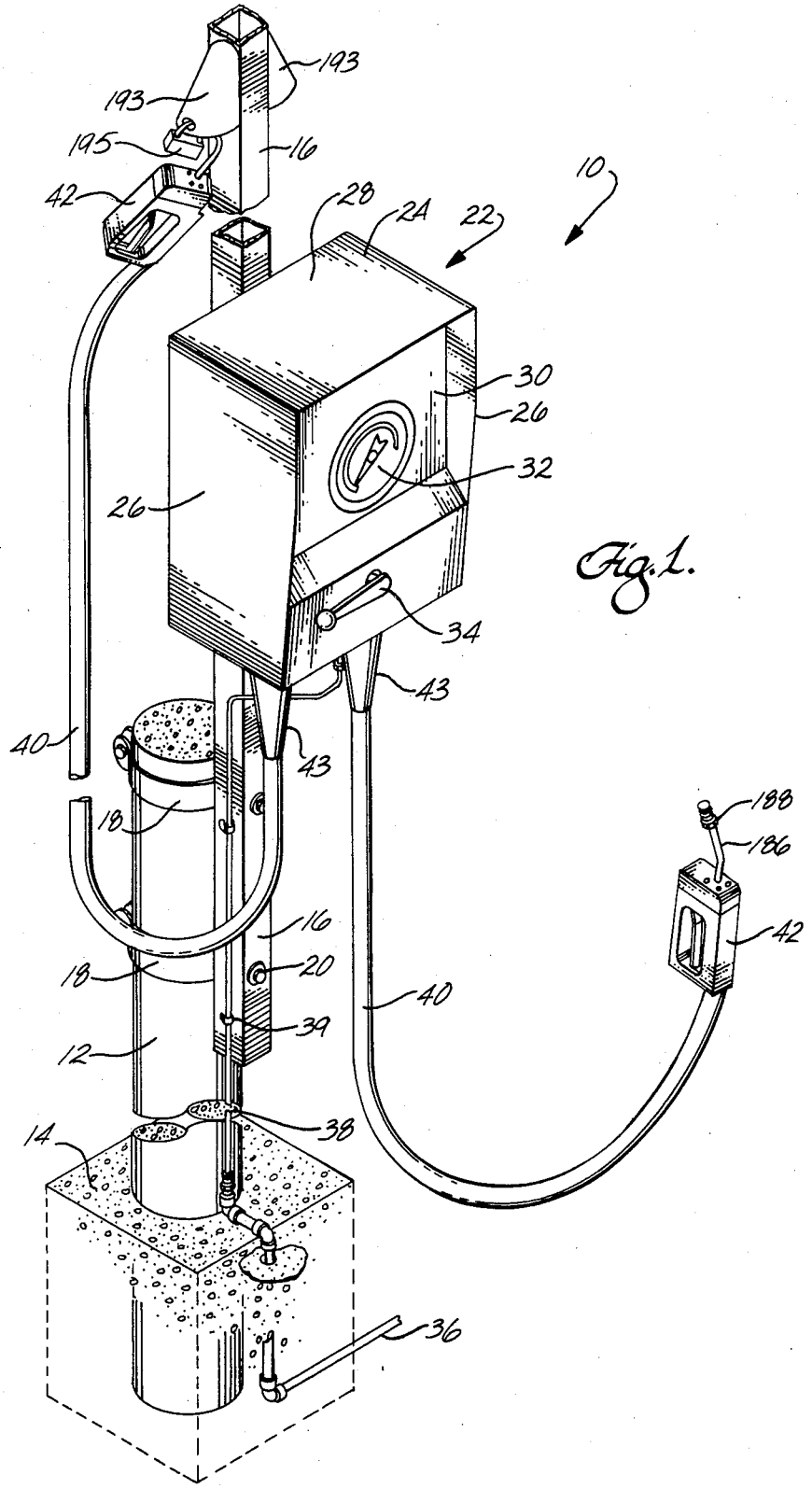
FIG. 1 is a prospective view of the natural gas fueling system.

Turning to the drawings, FIG. 1 shows the gas supply system 10 according to the present invention. The gas supply system 10 is adapted to fill tanks on vehicles (not shown) with natural gas. The vehicle tanks have coupling nipples which, when the tank is not being filled, is protected by a dust plug, cover or the like.

To support the components, the gas supply system 10 includes a stanchion 12, which may be a pipe filled with concrete, imbedded in a foundation 14.

Attached to the stanchion 12 is a rectangular vent 16. To attach the vent 16 to the stanchion 12 a number of collars 18 may be provided along the length of the stanchion 12, the collars 18 being adapted to receive bolts 20 passing through and attaching the vent 16 to the collars 18 and stanchion 12. The vent 16 has a closed bottom and extends along the stanchion 12 to vent natural gas safely away from the supply system 10.

The supply system 10 also includes a dispensing assembly 22. The dispensing assembly 22 is secured to the vent 16 by an appropriate means (not shown) and includes a closed outer housing 24 communicating with the vent 16. The housing 24 has side panels 26, top panel 28, bottom and rear panels (not shown) and a front panel 30. The front panel 30 has a portion thereof recessed from the edges of the side panels 26 and top panel 28 and has a bore to accommodate a pressure gauge face 32. The recess portion of the front panel 30 shades the pressure gauge face 32 to make it easier to read. The dispensing assembly 22 is located on the vent 16 at a location above the ground to permit the operators of the supply system 10 to easily view and reach the dispensing assembly 22. For purposes which will hereinafter become evident, a dispending valve handle 34 extends through. the front panel 30 into the housing 24.

To provide a continuous supply of natural gas to the dispensing assembly 22 an underground line 36 extends from a storage tank (not shown) or a gas main to a location adjacent to the stanchion 12. A riser 38 extends from the underground line 36 out of the ground and runs along the vent 16 for connection to the dispensing assembly 22. Clips 39, or the like, connect the riser 38 to the vent 16 for support.

To deliver the natural gas from the dispensing assembly 22, the supply system 10 includes a pair of hose assemblies 40. At one end, each hose assembly has a hand valve 42 which provides remote on-off control of the supply of natural gas. At the other end, each hose assembly has a protective shroud 43 which houses means to detachably support the hose assemblies 40 to the dispensing assembly 22. The supply system 10 shown in the drawings has two hose assemblies 40 to permit at least two tanks or two vehicles to be simultaneously filled. As can be appreciated, the supply system 10 is not limited to two hose assemblies but can have one or more.

Figure 2:
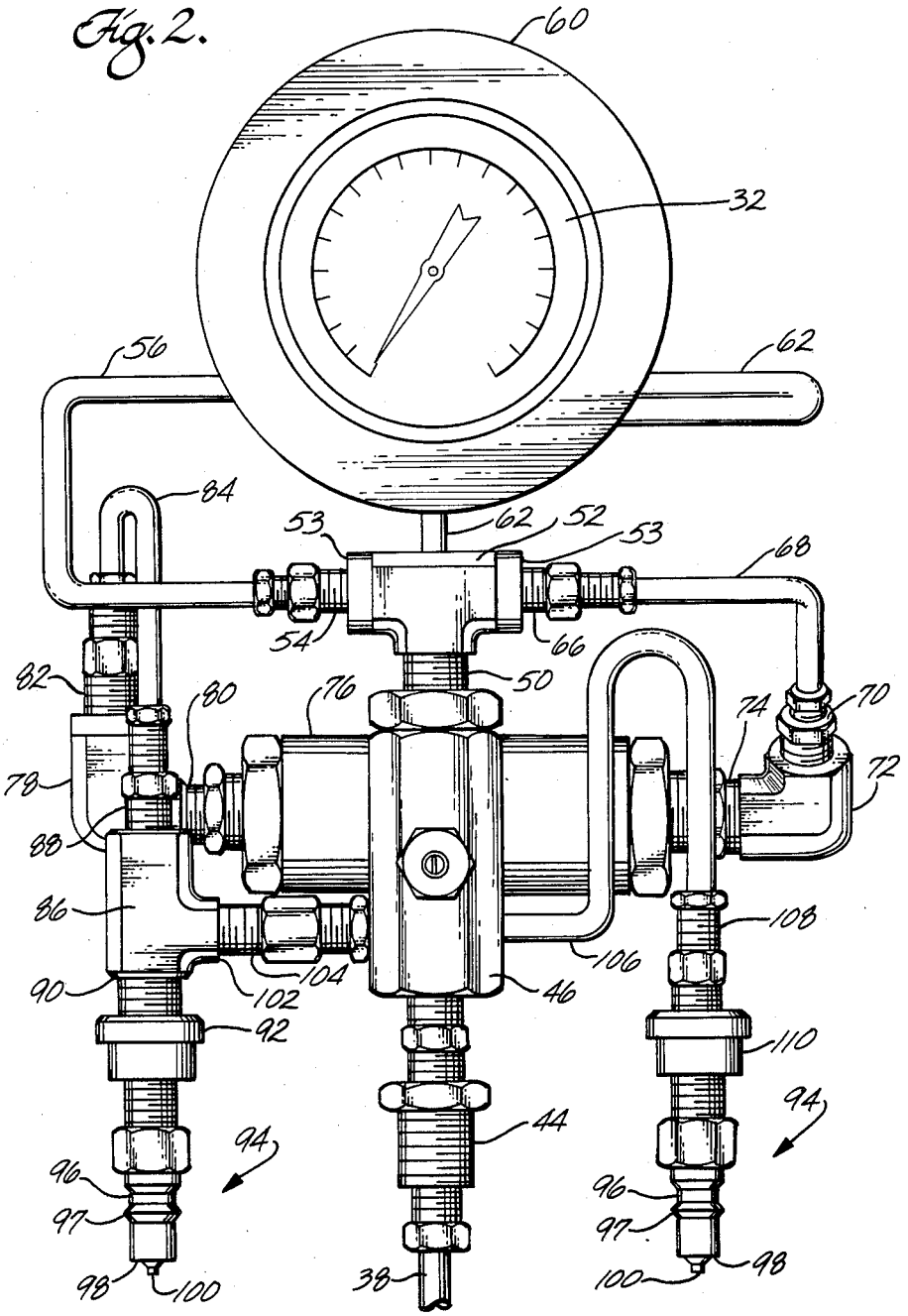
FIG. 2 is a front view of the inside of the dispensing terminal assembly of the fueling system.
Figure 3:
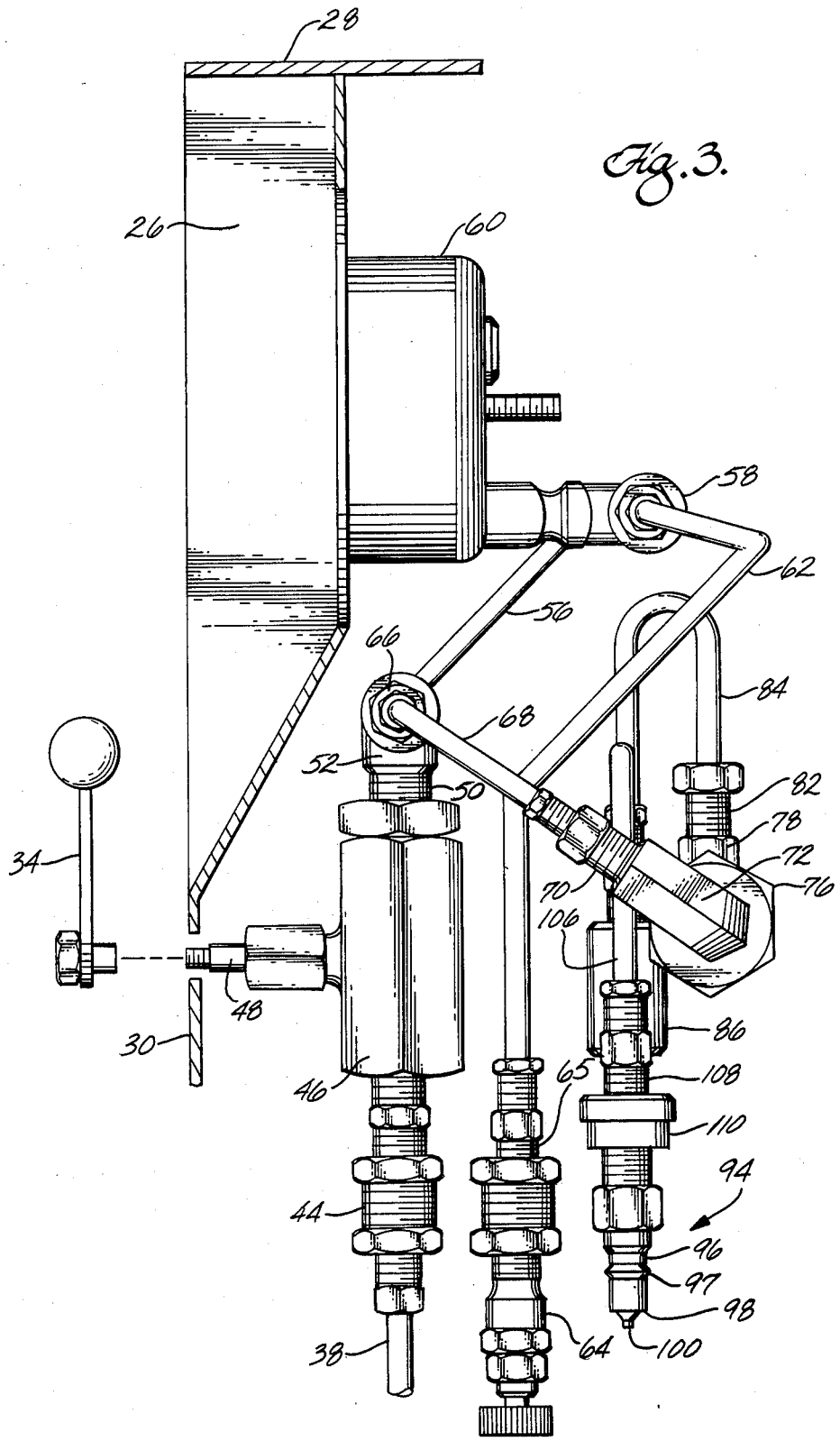
FIG. 3 is a side view of the internal components of the dispensing terminal assembly.

Turning to FIGS. 2 and 3, the dispensing assembly 22 is shown in detail with the housing 24 removed for clarity. The dispensing assembly 22 includes a threaded fitting 44, of well known construction, adapted to connect the riser 38 to a dispensing valve 46. The dispensing valve 46 is a ball valve having a stem 48 extending through the front panel 30 to mount the dispensing handle 34. Operation of the dispensing handle 34 accordingly, opens and closes the dispensing valve 46.

Connected to the dispensing valve 46 opposite the riser 38 is a threaded connection 50 which couples a first tee 52 to the dispensing valve 46. The first tee 52, in a well-known fashion, has opposing and coaxially arranged branch connections 53. One branch connection 53 has a fitting 54 interconnecting a gauge line 56 to the first tee 52 and dispensing valve 46. Line 56 as shown in FIGS. 2 and 3, extends from the tee 52 to a second tee 58 (FIG. 3) connected to the rear of a pressure gauge 60. Accordingly, the pressure of the gas flowing through the dispensing valve 46, when open, is communicated to the pressure gauge 60 which in turn indicates the pressure at the exteriorally visible pressure gauge face 32. A bleed line 62 extends from the other branch of the second tee 58 for connection to a bleed valve 64 (FIG. 3) via a fitting 65 of well-known construction. As will be described in detail below, the bleed valve 64 permits the supply system 10 downstream of the dispensing valve 46 to be vented to atmosphere so that the pressure of the vehicle tank when connected to the system 10 will register on the pressure gauge 60 as will be described later.

To supply natural gas to the hose assemblies 40, to the remaining branch connection 53 of the first tee 52 mounts a threaded fitting 66 which secures a conduit 68 to the tee 52. The end of the conduit 68 opposite the fitting 66 is connected by suitable fitting 70 to an elbow 72 which, in turn, via another fitting 74 is connected to a flow limiter 76. The flow limiter 76 is a restrictive device which reduces the normal flow of natural gas passing through the dispensing valve 46 to a rate suitable for safe dispersal through the system's vent 16 should a rupture occur in the dispensing hose(s) downstream of the flow limiter. The end of the flow limiter 76 opposite the elbow 72 is interconnected to a second elbow 78 via a suitable fitting 80.

To distribute the flow to the two hose assemblies 40, the outlet of the second elbow 78 is connected via suitable fitting 82 to a conduit 84 which is interconnected to a third tee 86 with a suitable fitting 88. The tee 86 has a first connection 90 coaxially arranged with the fitting 88, the first connection 90 being threaded to receive a male threaded first bulkhead fitting 92. Threadably connected to the first bulkhead fitting 92 is a male coupling 94 of a releasible coupling assembly. The coupling assembly being of the type commonly known as a quick-connect coupling with the male coupling 94 having a reduced neck 96, a retainer ring 97 and an outlet orifice 98. The male coupling 94 is adapted to mount a hose assembly 40 in a manner described in detail below. To prevent the flow of natural gas through the orifice 98 without connection of the hose assembly 40 to the male coupling 94, the male coupling 94 includes a check valve 100 adapted to prevent flow of natural gas through the orifice 98. When the hose assembly 40 is connected to the male coupling 94, the check valve 100 is displaced upward to open and permit the gas to flow through the orifice 98.

To supply gas to the other hose assembly 40, the tee 86 has a second connection 102 threadably mounting a fitting 104 which mounts one end of a conduit 106. The other end of the conduit 106 is interconnected by a fitting 108 to a second bulk head fitting 110. In a manner similar to that described above, the second bulk head fitting 110, threadably mounts a male coupling 94 of a releasible coupling assembly adapted to detachably mount a hose assembly 40.

Figure 4:
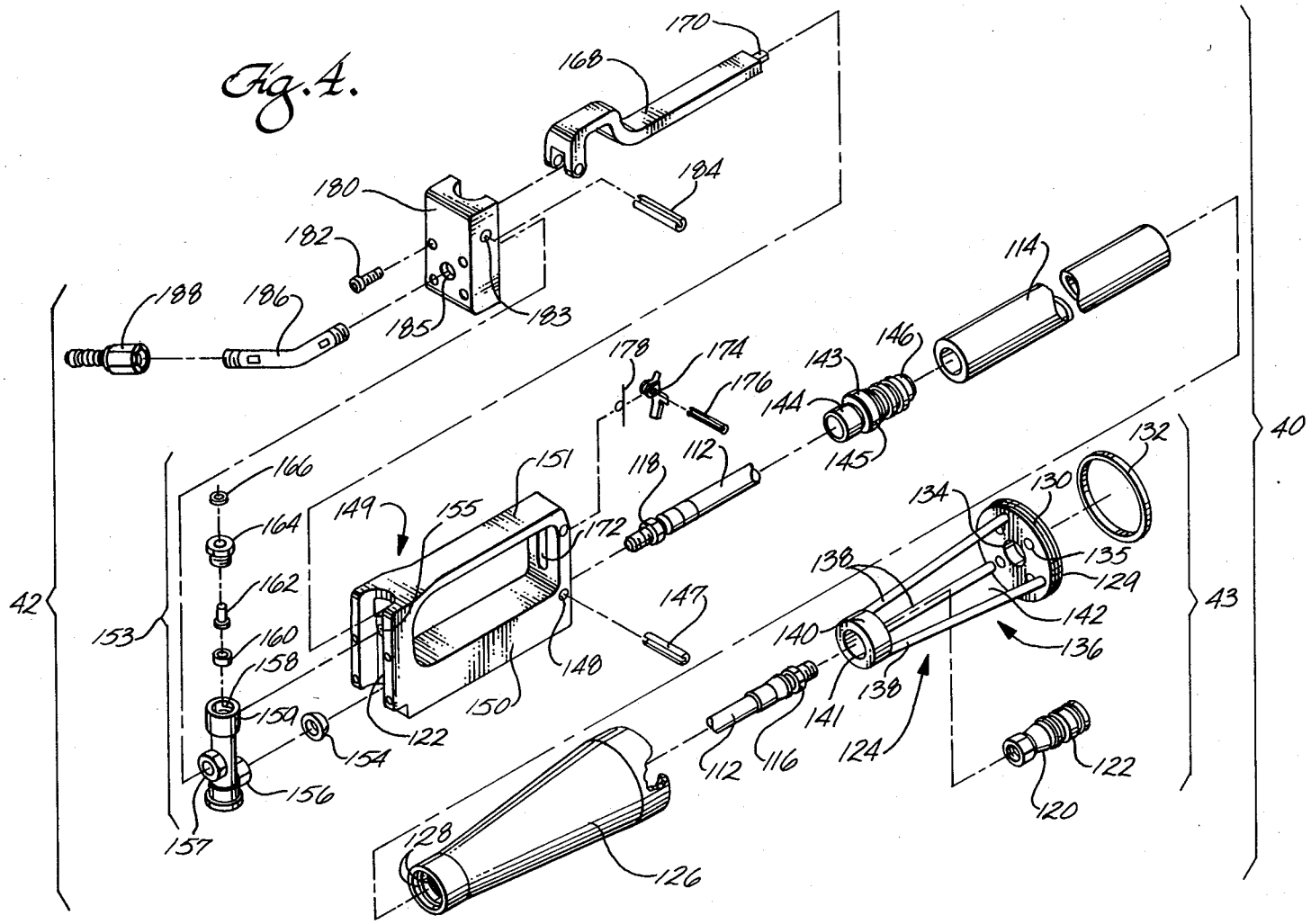
FIG. 4 is an exploded view of a fueling system hose assembly.

Turning to FIG. 4, the hose assembly 40 of the present invention is shown in detail. The hose assembly 40 includes an inner, flexible delivery hose 112, protected by an outer vent hose 114. The vent hose 114 is adapted to protect the hose 112 from damage and to collect any escaping gas and direct it to the housing 24 and vent 16. The hose 112 has at one end, a threaded fitting 116 and at the other end a similar fitting 118. The fitting 116 is adapted to be threadably connected to a female coupling 120 of the releasable coupling assembly.

The female coupling 120 detachably receives the male coupling 94; the female coupling 120 having a spring loaded collar 122 to pass over the retainer ring 97 and close down on the neck 96 to releasably interconnect the components and open the check valve 100 in the male coupling 94. The female coupling 120 also includes a second check valve (not shown) arranged to prevent flow from the vehicle tank through the hose 112 and out through the female coupling 120. As can be appreciated, when the hose assembly 40 is coupled to the dispensing assembly 22 and more particulary the male coupling 94, natural gas is free to flow from the dispensing assembly 22 through the coupling assembly and hose 112. However, should the hose assembly 40 be pulled sufficiently to cause the collar 122 of the female coupling 120 to release from the neck 96 and, more particularly, the retainer ring 97 of the male coupling 94 and separate the hose assembly 40 from the dispensing assembly 22, the check valves disposed in the male and female couplings 94 and 120 will prevent gas from flowing to the atmosphere from the dispensing assembly 22 and more particularly the orifices 98 of the male couplings 94, and from the vehicle tank and hose 112. This, in turn, reduces the liklihood of explosion or fire which may occur should the natural gas be permitted to escape.

To support the hose assembly 40 in the vicinity of the male and female couplings 94 and 120, the fueling system 10 includes the protective shroud 43. The shroud 43, as shown in FIG. 4, has a rigid frame 124 and a protective covering 126. The protective covering 126 has at its larger diameter end an internal retaining lip 127 and at its smaller diameter sealing ridges 128 on its inner surface. The frame 124 has a circular base 129 with a circumferential groove 130 adapted to receive the retaining lip 127 and a radial groove (not shown) adapted to receive a sealing o-ring 132. Extending coaxially through the base 129 is a bore 134 of a diameter to pass over the male coupling 94, but smaller than the diameter of the spring loaded collar 122 of the female coupling 120. Located radially around the base bore 134 and within the circumference of the groove that receives the o-ring 132 are a plurality of bores 135 through the frame base 129. The bores 135 serve to communicate the space 142 with the housing 24 and vent 16. To releasably mount the frame 124 against the housing 24, the bottom panel has a surface (not shown in FIG. 4) adapted to closely receive the frame base 129 which is sealed against the housing 24 by the O-ring 132.

Connected to and extending from the base 129 is a tripod 136 having legs 138 and a ring-shaped head 140 with an axial bore 141. The space between the base 129, head 140, and legs 138 defines a conical space 142 to house the female coupling 120 and portion of the male coupling 94 (not shown in FIG. 4). The female coupling 120, as shown in FIG. 4, is disposed in the space 142 and its spring loaded collar is of a diameter larger than the diameter of the base bore 134 so as not to pass therethrough. To releasably connect the hose assembly 40 to the dispensing assembly, the frame 124 is mounted against the bottom panel of the housing 24 as described above with the male coupling 94 passing through the bore 134 into the space 142. The delivery hose 112 and, more particularly, the female coupling 120 is thereafter coupled to the male coupling 94 thereby releasably interconnecting the hose assembly 40 to the dispensing assembly 22. Accordingly, it is to be understood that pulling the shroud 43 and, more particularly, the frame 124 from the housing 24 causes the base 129 to release from the housing 24 by virtue of depressing the spring-loaded collar 122 of the female coupling 120.

To connect the vent hose 114 and protective covering 126 to the shroud 43, one end of the vent hose 114 is passed through the sealing ridges 128 of the smaller diameter end of the protective covering 126 and through the head bore 141 of the frame 124 into the space 142. Then the protective covering 126 is slid over the frame 124 until the retainer lip engages the groove 130. Any escaping gas from the hose 112 is directed by the vent hose 114 through the shroud 43 and housing 24 to the vent 16.

As can be appreciated, the shroud 43 supports the hose assembly 40 in the region adjacent to the coupling assembly. The stresses induced by the bending of the hose assembly 40 will be transferred to the shroud 43 thereby protecting the male and female couplings 94 and 120 of the coupling assembly. For example, without the shroud assembly employed, should the operator excessively stretch the hose assembly 40 so as to reach a remote vehicle tank, the bending stresses may tend to pull the hose 112 from the fitting 116 or may induce sufficient radial forces upon the coupling assembly to inhibit the normal release of the hose assembly 40 from the housing 24. This, in turn, subjects the hose assembly 40 to possible breakage. Breakage of the hose assembly 40 would release natural gas from the vehicle tank and from the gas supply. Accordingly, the shroud 43 as employed, not only protects the male and female couplings 94 and 120 but also assures that the male coupling 94 will be released by the female coupling 120 should the hose assembly 40 be pulled with sufficient force.

Opposite the dispensing assembly 22, the hose 112 is connected to the hand valve 42 by its threaded fitting 118. The vent hose 114 is also attached to the hand valve 42 by means of a hollow hose fitting 143. The hose fitting 143 has at one end a shoulder 144 and a circumferential groove 145 adapted to be received by an axial bore (not shown) in the hand valve 42. At the other end of the hose fitting 143 are a plurality of circumferential rims 146 adapted to closely receive the internal surface of the vent hose 114. To secure the assembled hose and fitting, 114 and 143, to the hand valve 42, a roll pin 147 is closely received by a lateral bore 148 and the groove 145.

The hand valve 42, as shown in FIG. 4, has a rectangular frame 149, with a grip portion 150 and a guard portion 151. Passing longitudinally through the grip portion 150 is a gas passageway (not shown) which terminates at a recess 152 adapted to mount a refueling valve 153. A seal 154 seals the interconnection between the passageway and the recess 152 for mounting the refueling valve 153. Passing diagonally through the grip portion 150 is a second gas passageway 155 extending from the longitudinal passageway and terminating at the recess 152. A second seal (not shown) seals the interconnection between the second passageway 155 and the recess 152.

The refueling valve 153 has threaded female inlet and outlet connections 156 and 157 and an actuator passageway 158. Extending radially from the actuator passageway 158 through the refueling valve housing is a vent orifice 159 that aligns with the second passageway 155. Disposed in the actuator passageway 158 is an actuator mechanism which includes a spacer ring 160 supporting an actuator pin 162. The actuator pin 162 is also supported by a retaining nut 164 and is sealed against the escape of natural gas by an o-ring 166. When assembled, the actuator pin 162 protrudes from the retaining nut 164 when the refueling valve 153 is in the off position. When the actuator pin 162 is depressed, the vent orifice 159 is sealed and the refueling valve 153 opens to allow natural gas to pass therethrough.

To depress the actuator pin 162 the hand valve 42 includes a pivoting lever 168. The lever is S-shaped and is disposed in the hand valve 42 between the grip portion 150 and guard 151. The lever 168 passes through the handle frame 149 and extends over the refueling valve 153. The underside of the lever 168 adjacent to the refueling valve 153 engages the pin 162 so that movement of the lever 168 depresses the pin 162 to seal the vent orifice 159 and open the refueling valve 153. The lever 168 also has a tail piece 170 adapted to be received in a cooperative slot 172 in the handle frame 149 to guide the pivoting of the lever 168. Additionally, the hand valve 42 includes a latch 174 pivotally disposed on the handle frame 149 by a roll pin 176. A spring 178 disposed between the latch 174 and handle frame 149 normally urges the latch 174 to a position free of the lever 168. However, should the operator wish to latch the lever 168 in a position wherein the refueling valve 153 is open, the latch 174 is pivoted against the bias of the spring 178 to hold the hand valve 42 in an open position.

To house the refueling valve 153 and to pivotally mount the lever 168, the hand valve 42 includes a cap 180. The cap 180 is adapted to cover the refueling valve 153 and to be secured to the handle frame 149 by four screws 182, only one of which is shown on the drawing. The cap 180 also includes lateral bores 183, only one of which is shown, adapted to closely receive a roll pin 184 which passes through and pivotally mounts the lever 168 to the handle frame 149. A bore 185 in the cap 180 passes an outlet pipe 186, one end of which is threadably connected to the outlet connection 157 of the refueling valve 153. The other end of the outlet pipe 186 threadably mounts a refueling probe 188 adapted to connect to the refueling nipple on the vehicle tank.

To fill the tank on the vehicle the refueling system 10 is first bled of residual natural gas. With the handle 34 of the dispensing valve 46 in the closed position, the bleed valve 64 is opened until all natural gas is bled from the system downstream of the closed dispensing valve 46. The bleed valve 64 is then closed. The operator takes the hand valve 42, removes the dust plug (not shown) from the receptacle (not shown) on the vehicle tank (not shown) and inserts the refueling probe 188 into the vehicle tank recepticle. The operator squeezes the hand valve 42 causing the lever 168 to move to the open position sealing the vent orifice 159 and opening the refueling valve 153. With the refueling valve 153 in the open position, the pressure gauge 60 now registers the pressure existing in the vehicle tank. Latching the lever 168 in the open position, the operator returns to the dispensing assembly 22 and it rotates the handle 34 to open the dispensing valve 46. Natural gas from supply flows through the dispensing assembly 22, hose assembly 40 and hand valve 42 the vehicle tank for refueling. When the vehicle tank has been pressurized, the latch 174 is released, and the lever 168 is returned to the closed position, allowing the actuator pin 162 to close the refueling valve 153 and open the vent orifice 159; thus stopping the flow of supply gas and venting the residual gas pressure contained within the outlet pipe 186 and refueling prove 188. The vented gas is directed by the second gas passage 155 into the longitudinal gas passage, on through the hose fitting 144, the vent hose 114, the shroud 42, and housing 24 to the vent 16. The hand valve 42 and more particularly the refueling probe 188 is removed from the vehicle tank, and the handle 34 is returned to the off position.

In the event that the vehicle is driven away without first disconnecting the hand valve 42 from the vehicle tank, the hose assembly 40 will be pulled with sufficient force to cause the male and female couplings 94 and 120 to release and the shroud 122 to disconnect from the housing 22 to prevent damage to the dispensing assembly 22 and its components. The separation of the hose assembly 40 from the dispensing assembly 22 is accommodated by the male and female couplings 94 and 120 which release the hose 112 and at the same time close off the flow of gas from the dispensing assembly 22 and from the vehicle tank. This, in turn, prevents the escape of dangerous amounts of natural gas.

Figure 6:
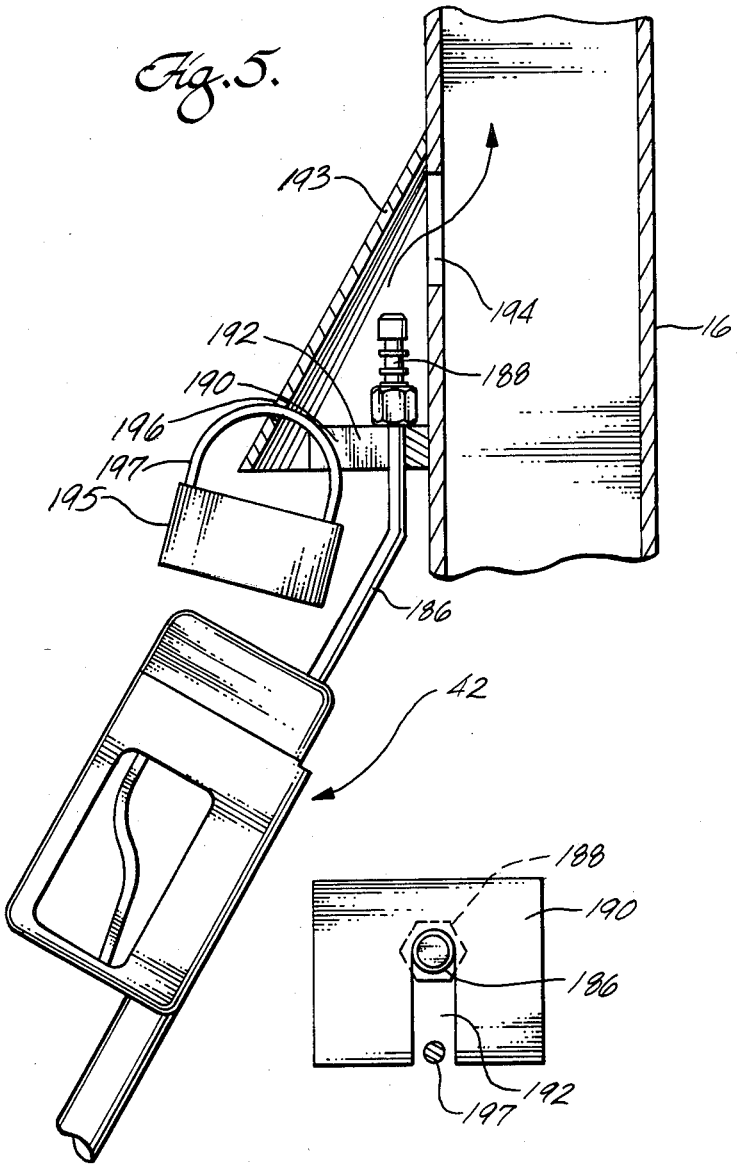
FIG. 6 is a bottom view of the locking mechanism of FIG. 5.

Turning to FIGS. 5 and 6, another feature of the present invention is shown in detail. To prevent unauthorized use of the refueling system 10, the supply system 10 includes a support plate 190 disposed on the vent 16. The support plate 190 has a groove 192 adapted to receive the outlet pipe 186 as best shown in FIG. 5. However, the groove 192 is insufficient to pass a refueling probe 188. Accordingly, to hold the hand valve 42 when not in use, the operator inserts the outlet pipe 186 into the groove 192 such that the refueling probe 188 will bear against the support plate 190.

Also disposed on the vent 16 is a conical hood 193 adapted to extend outwardly from the vent 16 to envelop the support plate 190. A passageway 194 in the vent 16 communicates with the interior of the hood 193. Accordingly, when the hand valve 42 is retained by the support plate 190, any residual gas or gas escaping from a leak or the like, is collected by the hood 193 and directed to the vent 16 through the passageway 194.

To lock the hand valve 42 to the support plate 190, a shackle 197 of a padlock 195 is passed through an appropriate opening 196 in the hood 193 and through the groove 192 to prevent the outlet pipe 186 from being removed from the groove 192. Accordingly, removal of the padlock 195 is required before the supply system 10 can be used.

While I have shown and described certain embodiments of the present invention, it is to be understood that it is to be subject to many modifications without departing from the spirit and scope of the attached claims.

What is claimed is:

1. A gas refueling system for filling a pressurized tank from a pressurized gas supply comprising:

an upstanding support stanchion;

a dispensing assembly supported by the stanchion, the dispensing assembly including a valve having an inlet connected to the gas supply and two outlets, each including a male coupling;

a pair of hoses each having a first end adapted to connect to the tank for filling and an other end having a female coupling adapted to releasably connect to one of the male couplings such that opening of the valve delivers gas from the supply through the dispensing assembly and hose assembly to a tank;

a vent disposed along the stanchion, the vent including a pair of support plates each adapted to hold one first end of said hoses, the vent also including a pair of hoods to collect gas released from the first ends, each support plate having a groove to receive one first end; and means for locking the first ends to the support plates including padlocks adapted to be disposed in the grooves.

* * * * *